US005535463A

United States Patent [19]

Chiu

[11] Patent Number: 5,535,463

[45] Date of Patent: Jul. 16, 1996

[54] WATER BED WITH PERIPHERAL AIR TUBE

[76] Inventor: K. Jung Chiu, P.O. Box 82-144, Taipei City, Taiwan

[21] Appl. No.: 396,754

[22] Filed: Mar. 1, 1995

[51] Int. Cl.[6] ..... A47C 27/10

[52] U.S. Cl. ..... 5/452; 5/457; 5/932

[58] Field of Search ..... 5/451, 452, 457, 5/932, 919, 458, 455, 449

[56] References Cited

U.S. PATENT DOCUMENTS

| | | | |
|---|---|---|---|
| 3,780,388 | 12/1973 | Thomas et al. | 5/457 |
| 3,864,768 | 2/1975 | Fraige et al. | 5/452 |
| 3,925,835 | 12/1975 | Pennington et al. | 5/452 |
| 4,038,712 | 8/1977 | Miller | 5/932 |
| 4,190,917 | 3/1980 | Calleance | 5/451 |
| 4,611,357 | 9/1986 | Chelin | 5/919 |

FOREIGN PATENT DOCUMENTS

| | | | |
|---|---|---|---|
| 774719 | 5/1957 | United Kingdom | 5/457 |
| 8704605 | 8/1987 | WIPO | 5/932 |

*Primary Examiner*—Alexander Grosz
*Attorney, Agent, or Firm*—Alfred Lei

[57] ABSTRACT

An improvement in structure of a water bed including a water filled body portion having an upper portion and a lower portion, an air filled protection tubular member surrounding an inner edge of the body portion, a plurality of generally X-shaped partitions connected between the upper portion and the lower portion by high frequency heating, and a plurality of first triangular water filled chambers each formed between a top of each of the generally X-shaped partitions and the upper portion and second triangular water chambers each formed between a bottom of each of the generally X-shaped partitions and the lower portion.

1 Claim, 3 Drawing Sheets

WATER BED WITH PERIPHERAL AIR TUBE

BACKGROUND OF THE INVENTION

Referring to FIGS. 1 and 2, the conventional water bed includes a body portion having a plurality of tubular members A for receiving water and an air passage B surrounding the body portion. The air passage B is connected with the body portion by high frequency heating. Between the air passage B and the first tubular member A there is a partition B1. Further, there is a partition A1 between every two of the tubular members A. As the water is pressed, the joints B2 and A2 between the upper layer C1 and the lower layer C2 will be directly impacted by water thereby permitting the partitions to be damaged easily.

Therefore, it is an object of the present invention to provide an improvement in the structure of a water bed which can obviate and mitigate the above-mentioned drawbacks.

SUMMARY OF THE INVENTION

This invention relates to an improvement in the structure of a water bed.

It is the primary object of the present invention to provide a water bed which is strong in structure.

It is another object of the present invention to provide a water bed which has long working life.

It is still another object of the present invention to provide a water bed which can prevent the partitions from tearing off by the water pressure.

It is still another object of the present invention to provide a water bed which is easy to manufacture.

It is a further object of the present invention to provide a water bed which is simple in construction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
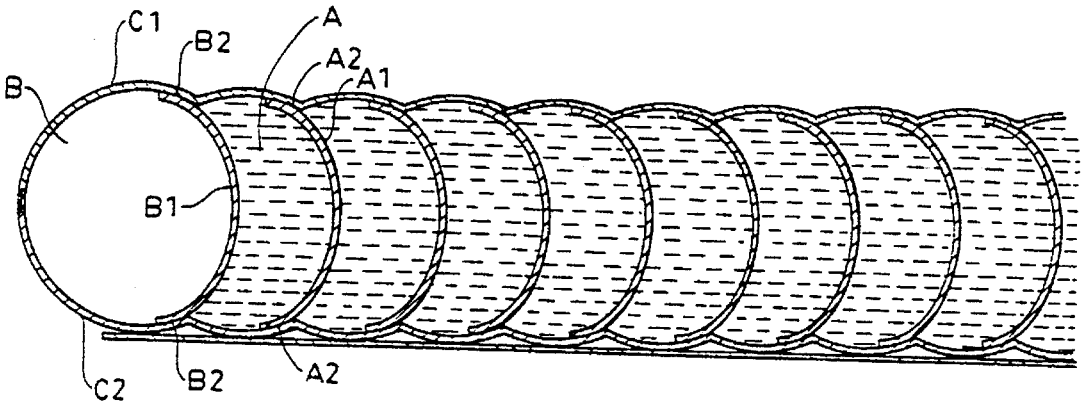
PRIOR ART FIG.1
FIG. 1 is a sectional view of a prior art water bed.
Figure 2:
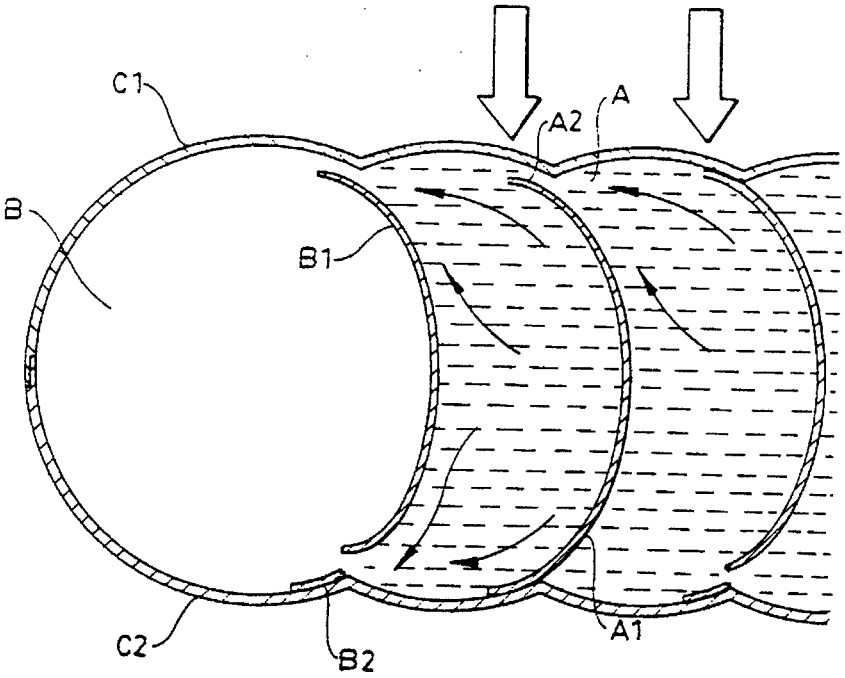
PRIOR ART FIG.2
FIG. 2 shows the working principle of the prior art water bed.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
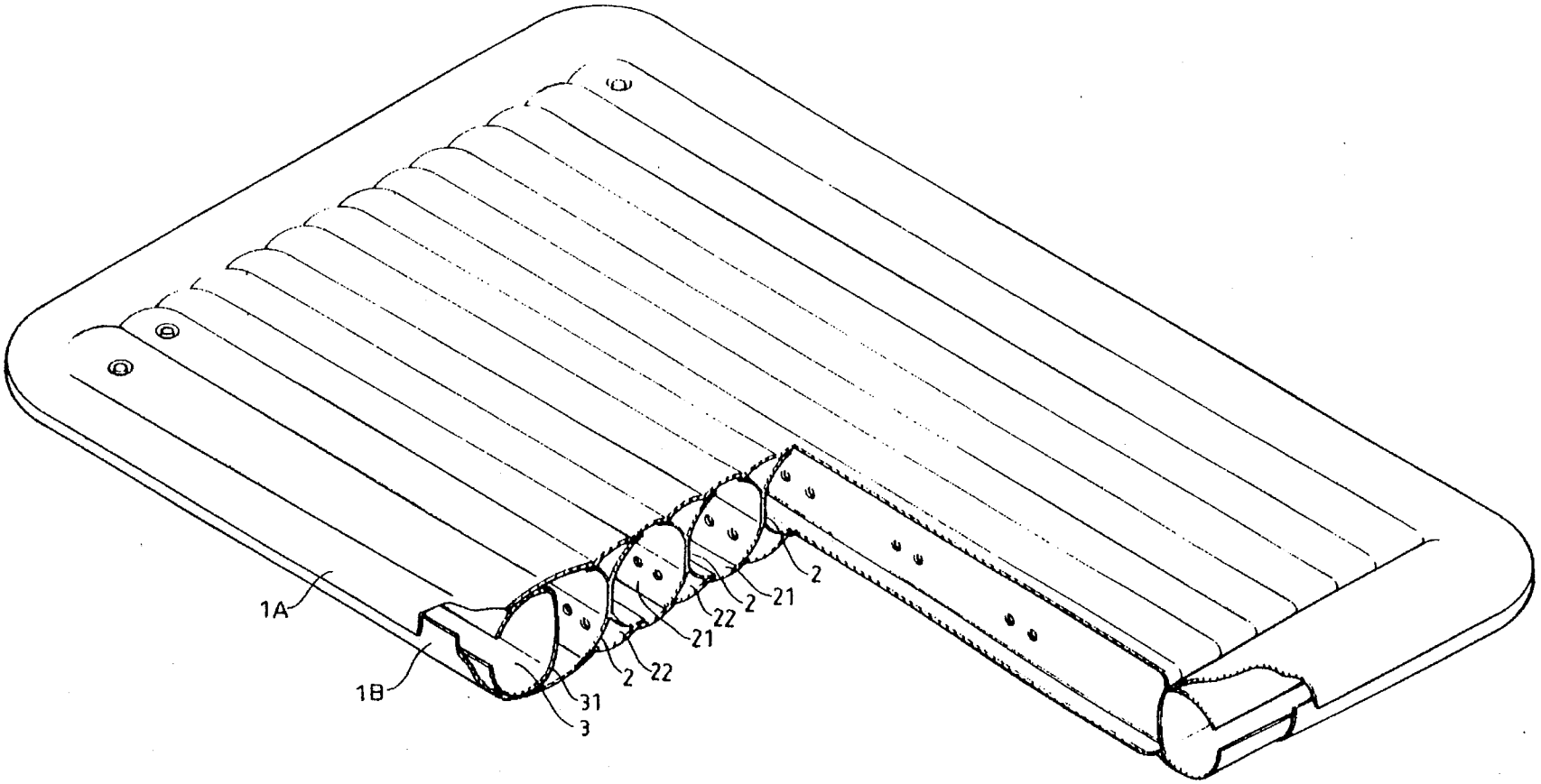
FIG. 3 is a partly broken perspective view of the present invention.
Figure 4:
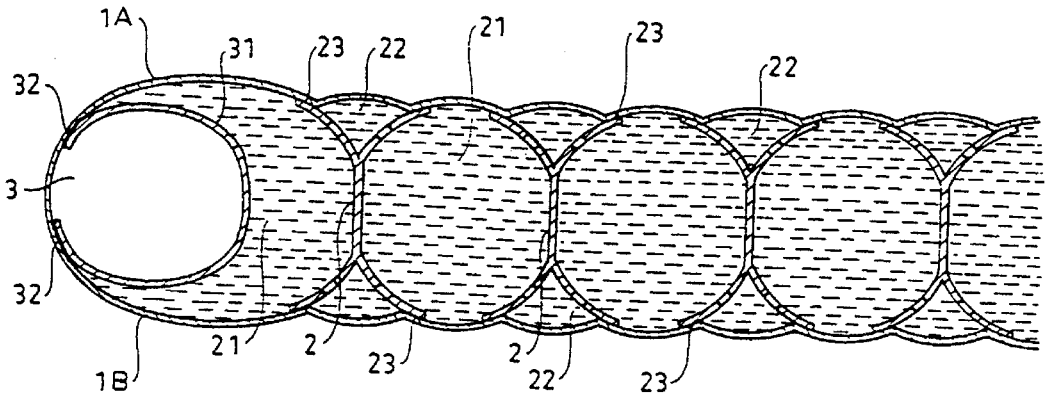
FIG. 4 is a sectional view of the present invention.

With reference to the drawings and in particular to FIGS. 3 and 4, the water bed according to the present invention comprises a water filled body portion provided with an air filled protection tubular member 3 surrounding the inner surface of the water filled body portion. The water filled body portion includes an upper portion 1A and a lower portion 1B. A plurality of generally X-shaped partitions 2 are provided between the upper portion 1A and the lower portion 1B.

The generally X-shaped partitions 2 are connected with the upper portion 1A and the lower portion 1B at seams 23 by high frequency heating. Between every two generally X-shaped partitions 2 there is a water chamber 21. A plurality of first triangular water filled chambers 22 are each formed between the top of each of the generally X-shaped partitions 2 and the upper portion 1A. In addition, a plurality of second triangular water filled chambers are each formed between the bottom of each of the generally X-shaped partitions 2 and the lower portion 1B.

As shown in FIG. 4, the air filled protection tubular member 3 includes a partition 31 which has a cross section of a laterally inverted English letter C, with its open mouth joined to the inner perimeter of the body. The partition 3 is joined with the upper portion 1A and the lower portion 1B by high frequency heating at two sides of its mouth 32.

Figure 5:
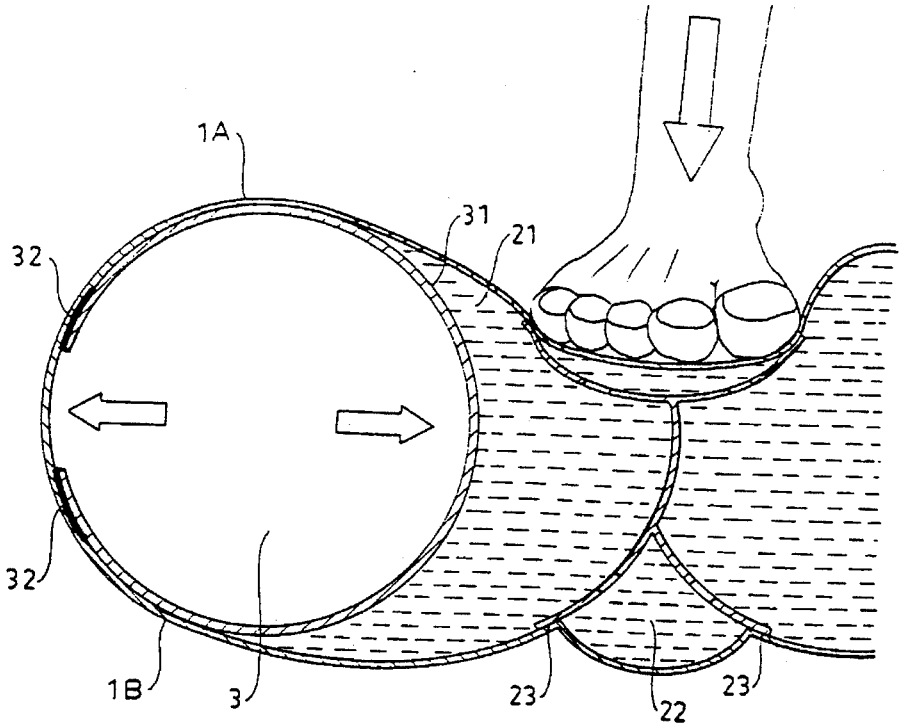
FIG. 5 is a working view of the present invention.

Looking now at FIG. 5, when the triangular water filled chamber 22 is pressed, the impact produced by the triangular water filled chamber 22 is relatively low as the triangular water filled chamber 22 contains only a small amount of water, thereby preventing the seams 23 from being torn off. In the meantime, the laterally inverted C-shaped partition 31 will be compressed to form a circular tubular chamber thus increasing the contact area between the partition 31 and the upper portion 1A and the lower portion 1B and therefore preventing the mouth 32 from being impacted directly by water.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An improvement in structure of a water bed mattress comprising:

a water filled body portion having an upper portion and a lower portion;

an air filled protection tubular member surrounding the inner perimeter of said body portion;

a plurality of generally X-shaped partitions connected between said upper portion and said lower portion by high frequency heating; a plurality of first triangular water filled chambers each formed between a top of each of said generally X-shaped partitions and said upper portion and a plurality of second triangular water filled chambers each formed between a bottom of each of said generally X-shaped partitions and said lower portion, wherein said protection tubular member has a cross section of a laterally inverted English letter C, with its open mouth portion joined to the inner perimeter of said body portion.

* * * * *